US010470532B2

(12) United States Patent
Mace

(10) Patent No.: US 10,470,532 B2
(45) Date of Patent: Nov. 12, 2019

(54) ADJUSTING DEVICE FOR BRACELET

(71) Applicant: ROLEX SA, Geneva (CH)

(72) Inventor: Jean-Sebastien Mace, Esserts-Salève (FR)

(73) Assignee: ROLEX SA, Geneva (CH)

( * ) Notice: Subject to any disclaimer, the term of this patent is extended or adjusted under 35 U.S.C. 154(b) by 72 days.

(21) Appl. No.: 15/455,316

(22) Filed: Mar. 10, 2017

(65) Prior Publication Data

US 2017/0265606 A1 Sep. 21, 2017

(30) Foreign Application Priority Data

Mar. 15, 2016 (CH) ..... 0346/16
Mar. 15, 2016 (EP) ..... 16160333

(51) Int. Cl.

| | |
|---|---|
| ***A44C 5/08*** | (2006.01) |
| ***A44C 5/10*** | (2006.01) |
| ***A44C 5/02*** | (2006.01) |
| ***A44C 5/00*** | (2006.01) |
| ***A44C 5/24*** | (2006.01) |

(52) U.S. Cl.

CPC ..... *A44C 5/027* (2013.01); *A44C 5/0015* (2013.01); *A44C 5/0069* (2013.01); *A44C 5/107* (2013.01); *A44C 5/24* (2013.01); *A44C 5/246* (2013.01)

(58) Field of Classification Search

CPC ..... A44C 5/027; A44C 5/0015; A44C 5/0069; A44C 5/107; A44C 5/24; Y10T 24/213; Y10T 24/4782; Y10T 24/2155

USPC ..... 368/282

See application file for complete search history.

(56) References Cited

U.S. PATENT DOCUMENTS

| | | | | |
|---|---|---|---|---|
| 3,521,331 A * | 7/1970 | Gay | ..... | A44C 5/24 24/265 R |
| 6,401,307 B1 | 6/2002 | Wild | | |
| 2007/0125123 A1 | 6/2007 | Sierro | | |

FOREIGN PATENT DOCUMENTS

| | | |
|---|---|---|
| DE | 197 29 903 A1 | 1/1999 |
| EP | 1 790 247 A1 | 5/2007 |

OTHER PUBLICATIONS

European Search Report and Written Opinion dated Sep. 15, 2016 issued in counterpart application No. EP16160333; w/ English partial translation and partial machine translation (12 pages).

* cited by examiner

*Primary Examiner* — Jack W Lavinder
(74) *Attorney, Agent, or Firm* — Westerman, Hattori, Daniels & Adrian, LLP

(57) ABSTRACT

Bracelet having adjustable length, which includes an adjusting link (6) with two parallel transverse articulation pins (5, 7), a first (5) being fixed and the second (7) being able to pivot with respect to the first (5) so as to reverse the respective positions of the pins and respectively create two, short and long, configurations, and an end link (8) having a first end (8*i*) pivoted on the second pin (7) and a second end (8*j*) designed to accept the fixing of the end of one bracelet strand, this second end (8*j*) having at least one first cutout (8*e*) designed to house a center link element (10*a*) of a link at the end of said bracelet strand, and a transverse second cutout (8*c*) arranged between the two ends (8*i*, 8*j*) of the end link (8) to house the first pin (5) of the adjusting link (6) in the short configuration.

19 Claims, 4 Drawing Sheets

ADJUSTING DEVICE FOR BRACELET

INTRODUCTION

This application claims priority of Swiss patent application No. CH00346/16 filed Mar. 15, 2016 and of European patent application No. EP16160333.7 filed Mar. 15, 2016, the contents of each of which are hereby incorporated by reference herein in their entirety.

The present invention relates to a device for adjusting the length of a bracelet, particularly suited to a bracelet equipped with a multi-fold clasp for a wrist watch, arranged between two ends of the bracelet in order to form therewith an endless connector the length of which can vary between two sizes. It also relates to a clasp and to a bracelet as such, incorporating such an adjusting device, and to a wrist watch as such comprising such a clasp or bracelet.

PRIOR ART

There are several solutions to attaching the two strands of a watch bracelet around the wrist of its wearer. In all cases, this attachment is provided with a main means of adjusting the length of the bracelet, so as to tailor it to the circumference of the wrist of its wearer.

One common solution in the prior art is to provide an intermediate element of the clasp type, arranged between the two strands of the bracelet, and which always remains secured to the ends of these two strands. Such a clasp occupies two positions: a closed position, intended for the wearing of the watch, in which the bracelet and the clasp extend around the circumference of the wrist exhibiting a total length that allows the wrist watch to be held in place, and an open position that allows the length of the bracelet and of the clasp to be lengthened by parting the two ends of the two strands of the bracelet, without detaching them from the clasp, so as to allow the hand to slip through and the watch to be removed. In this clasp-open configuration, the two strands of the bracelet are not disconnected, thereby minimizing the risk of the watch falling. The length of each strand of bracelet is chosen to correspond to the circumference of the wrist of the wearer when the clasp is in the closed position.

In all cases it is important to allow convenient adjustment of the length of the bracelet, which is easy and effective to use.

At the same time, it is also important to guarantee the esthetic integrity of the bracelet, notably through the harmonious continuity of the structure and appearance of the bracelet, even when the latter is of relatively complex structure, all the way to the ends of the strands, for example to a clasp. In particular, the components that contribute to the adjusting of the length of the bracelet must not alter the esthetic appearance of the bracelet.

Thus, the overall objective of the present invention is to propose a solution that allows the length of a bracelet to be adjusted, notably that allows comfortable adjustment of the length of a bracelet while at the same time ensuring the esthetic integrity thereof.

As a secondary consideration, the invention aims to meet all or some of the following additional objectives:

- of proposing a bracelet closure solution that is very convenient to operate;
- of proposing a bracelet closure solution that is secure when caught in the closed position;

- of proposing a bracelet closure solution the operation of which does not cause excessively rapid wear and that remains independent of the materials used.

BRIEF DESCRIPTION OF THE INVENTION

To this end, the invention relies on a device for adjusting the length of a bracelet, which comprises:

- an adjusting link equipped with two parallel transverse articulation pins, a first pin being fixed and the second pin being able to pivot with respect to the first pin so as to reverse the respective positions of these two articulation pins relative to one another and respectively create two, short and long, configurations of the adjusting device, and
- an end link comprising a first end pivoted on the second pin of the adjusting link and a second end designed to accept the fixing of the end of one strand of the bracelet, this second end comprising at least one first cutout designed to house a center link element of a link at the end of said strand of the bracelet, and a transverse second cutout arranged between the two ends of the end link to house the first pin of the adjusting link when the adjusting device is in the short configuration.

More specifically, the invention relies on a bracelet which comprises a succession of two links, each one respectively comprising three link elements and two link elements, these link elements being joined together in an articulated manner by at least one transverse pin, the bracelet thus being made up of five link elements juxtaposed in parallel across the width of the bracelet, the two link elements of the second link being interposed between two link elements of the first link and offset longitudinally with respect to said three link elements of a first adjacent link, and wherein the bracelet comprises at least one device for adjusting the length of the bracelet, comprising:

- an adjusting link equipped with two parallel transverse articulation pins, a first pin being fixed and the second pin being able to pivot with respect to the first pin so as to reverse the respective positions of these two articulation pins relative to one another and respectively create two, short and long, configurations of the adjusting device, and
- an end link comprising a first end pivoted on the second pin of the adjusting link and a second end designed to accept the fixing of the end of one strand of the bracelet, this second end comprising at least one first cutout designed to house a center link element of a link at the end of said strand of the bracelet, and a transverse second cutout arranged between the two ends of the end link to house the first pin of the adjusting link when the adjusting device is in the short configuration, the end link comprising a wall arranged at the level of the transverse second cutout of the end link to collaborate with a corresponding element of the adjusting link when the adjusting device is in the short configuration so as to perform a function of catching on this element and of ensuring that this short configuration of the adjusting device is maintained in a stable manner, and wherein the end of one strand of the bracelet comprises a first link with three link elements so that these three link elements are articulated on a pin connected to the second end of the end link, wherein the central link element of said first link is partially housed inside the first cutout of the end link and wherein the two outer link elements of said first link cover part of the exterior flanks of two lateral parts of the second end of the end link surrounding the first cutout.

The invention also relates to a wrist watch which comprises at least one device for adjusting the length of the bracelet and/or at least one bracelet which is/are as defined hereinabove.

The invention is more precisely defined by the claims.

BRIEF DESCRIPTION OF THE FIGURES

These objects, features and advantages of the present invention will be set out in detail in the following description of one particular embodiment given by way of nonlimiting illustration with reference to the attached figures among which.

To simplify the description, we shall by convention use the terms "longitudinal direction" for the direction along the length of a strand of the bracelet and "transverse direction" for the perpendicular direction, in the plane of a strand of the bracelet (across the width thereof). The vertical direction is the direction perpendicular to the first two directions, oriented perpendicular to the plane of the bracelet. Furthermore, we shall use the term "link element" for an elementary component of a bracelet and the term "link" for a group of link elements joined together and arranged at the same longitudinal level of a bracelet.

The invention relies on a device for adjusting the length of a bracelet. This adjusting device is aimed at allowing the user to have available, for each initial length of the bracelet as set by a conventional first main means of adjustment (means of adjustment distinct from the second means of adjustment according to the embodiment of the invention), a determined additional length differing by a fixed small amount from the length initially adjusted, so as to allow this user easily, with no skill or special tool, to switch from one bracelet length to the other. The difference between these two lengths is chosen to take account of the differences in wrist circumference according to the ambient heat and/or according to the effort that the wearer of the bracelet is performing with his or her arm and which causes the wrist to swell. Thanks to such an adjusting device, it is possible easily to switch from one of the determined lengths to the other, according to whether the bracelet is constricting the wrist or, on the other hand, not holding firmly enough around the wrist, without modifying the main initial adjustment (by the separate first means of adjustment) of the length of the bracelet. This is important, particularly but not exclusively, for a watch bracelet.

Advantageously, the adjusting device according to the embodiment of the invention is associated with a multi-fold clasp having two or three folding leaves. In addition, advantageously, it is compatible with a complex bracelet structure, for example a bracelet formed by a collection of links joined together by transverse pins, the number of links being chosen to define an initial adjustment corresponding more or less to the circumference of the user's wrist. Each link may comprise several link elements juxtaposed in a transverse direction, for example comprising one or more center link element(s) inserted between outer link elements. Such an assembly is, for example, depicted in FIG. 8.

Figure 8:
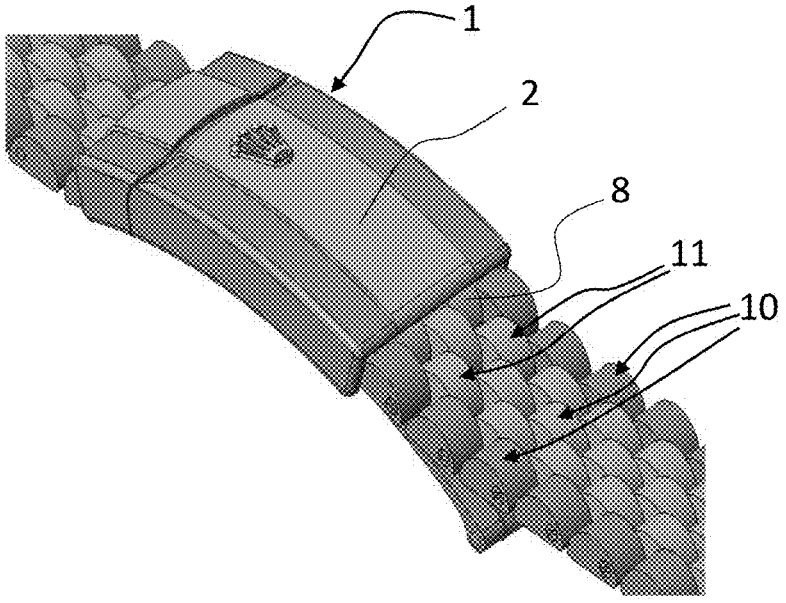
FIG. 8 depicts a perspective view from above of a bracelet equipped with a clasp incorporating a device for adjusting the length of the bracelet according to the embodiment of the present invention.

One particular embodiment will now be described in detail by way of nonlimiting example, notably with reference to FIGS. 1 to 3 which depict the adjusting device according to one embodiment of the invention in which the clasp 1 of FIG. 8 is depicted as transparent in order to provide a clear view of the mechanism arranged under the cover thereof.

The adjusting device according to this embodiment is arranged at the end of one strand of the bracelet, in the region of a clasp only a cover 2 of which has been depicted in dashed line in FIGS. 1 to 3*s*, so as to leave all the components of the adjusting device visible.

As may be seen from the figures, the bracelet is made up of a succession of pairs of links 10, 11, each one respectively comprising three link elements 10*a*, 10*b*, 10*c* and two link elements 11*a*, 11*b*. The first link 10 therefore comprises three link elements, these being two outer link elements 10*b*, 10*c* extending along the sides of the bracelet, and one center link element 10*a*. These three link elements are joined together by at least one transverse pin 12 passing through through-openings of these three link elements. These latter have the same length and extend parallel in the longitudinal direction, and their two longitudinal ends are positioned at the same level. The width L10*a* of the center link element 10*a* is less than or equal to that L10*b*, L10*c* of the two outer link elements 10*b*, 10*c*, which in this embodiment have the same length. Such a first link 10 is associated, on each of its two longitudinal ends, with a second link 11 made up of two link elements 11*a*, 11*b*. These two link elements 11*a*, 11*b* constitute center link elements. They are positioned in such a way as to become interposed respectively between the link elements 10*a*, 10*b* and 10*a*, 10*c* of the first link 10. Their end is mounted on a pin 12 connecting the three link elements 10*a*, 10*b*, 10*c* of the first link 10, in an articulated manner, leaving the two links 10, 11 free to rotate relative to one another. The two link elements 11*a*, 11*b* of the second link 11 are substantially identical and have the same length and the same shape as the three link elements 10*a*, 10*b*, 10*c* of the first link 10 and their end incorporated between two link elements of the first link is substantially in the middle of the length of the three link elements 10*a*, 10*b*, 10*c*. Their width is substantially the same, and substantially also the same as that of the center link element 10*a* of the first link 10. These widths of the link elements are such that the lateral edges of all the juxtaposed link elements, which take the form of flanks in a vertical longitudinal plane, come substantially into contact, leaving no visible gap. The three link elements 10*a*, 10*b*, 10*c* of two successive first links 10 come into contact along their longitudinal ends. The same is true of two successive second links 11: likewise, the two link elements 11*a*, 11*b* of two successive second links 11 come into contact along their longitudinal ends. All the link elements have a rounded visible upper surface and planar lateral flanks, oriented in a longitudinal and vertical direction.

The strand of bracelet obtained is thus made up of five link elements juxtaposed in parallel across the width of the bracelet, obtained by a succession of interposed links of respectively three link elements and two link elements, the two link elements being longitudinally offset from said adjacent three link elements. This construction gives rise to an esthetic appearance that is very harmonious, notably because of the large number of mutually articulated link elements, notably of narrow center link elements. In addition, this large number of link elements makes it possible to make this bracelet very comfortable to wear because the articulated link elements closely follow the contour of the wrist. This level of comfort decreases as the size of the link elements increases and/or as the number of link elements is reduced.

The end of such a bracelet is connected to an adjusting device, particularly a comfort adjustment of its length, configured to allow a slight change in the length of the bracelet, to complement a conventional initial adjustment as explained hereinbefore.

Figure 5:
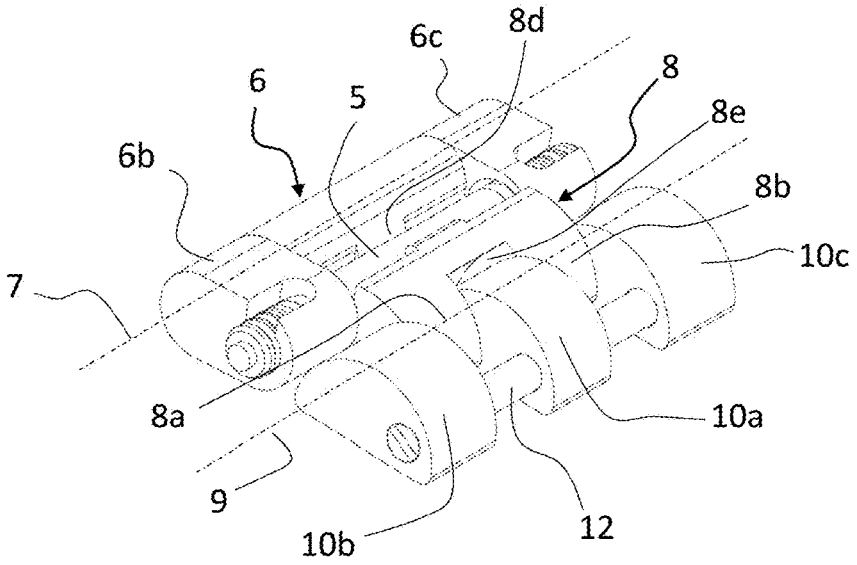
FIG. 5 depicts a perspective view of the device for adjusting the length of a bracelet according to the embodiment of the present invention.
Figure 6:
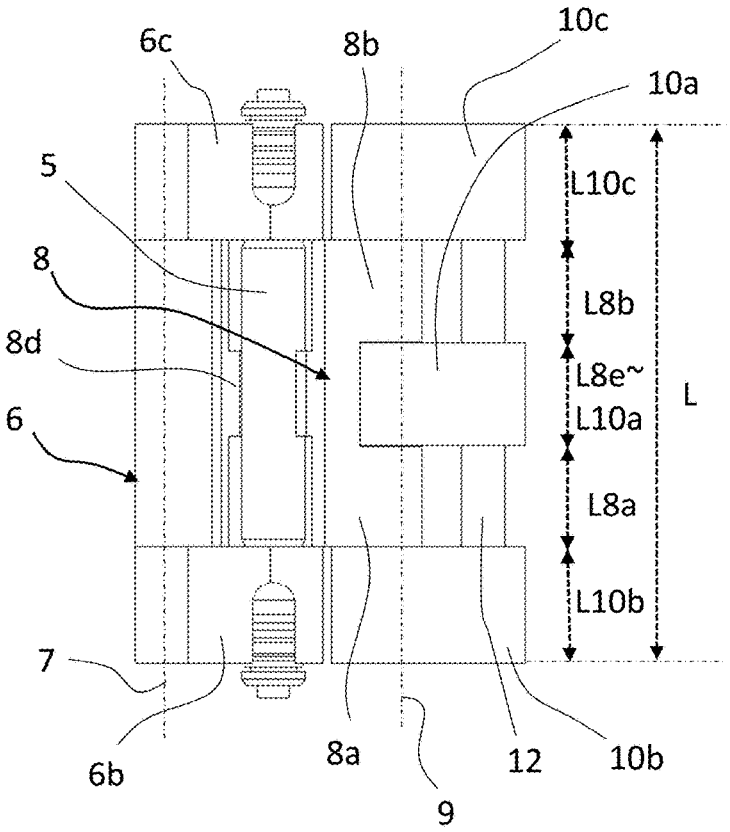
FIG. 6 depicts a view from above of the device for adjusting the length of a bracelet according to the embodiment of the present invention.

This adjusting device according to the embodiment of the invention, more particularly visible in FIGS. 5 and 6, comprises an adjusting link 6 pivot-mounted about a first pin 5, formed by a transverse bar fixed laterally in two perforations 4 present on the lateral walls that face one another in the region of the cover 2, belonging to a clasp 1 of the multi-fold type. This adjusting link 6 uses the bracelet length adjustment function. To do that, this adjusting link 6 comprises a second articulation pin 7, made up of a pin that has not been depicted, to which is articulated a first end 8*i* of a second link, referred to as end link 8, because its second end 8*j* is articulated to the end of the strand of bracelet around a second pin 9. The adjusting link 6 takes the form of two outer link elements 6*b*, 6*c* connected by the two pins 5, 7 mentioned. The end link 8 here takes the form of one single link element.

Figure 4:
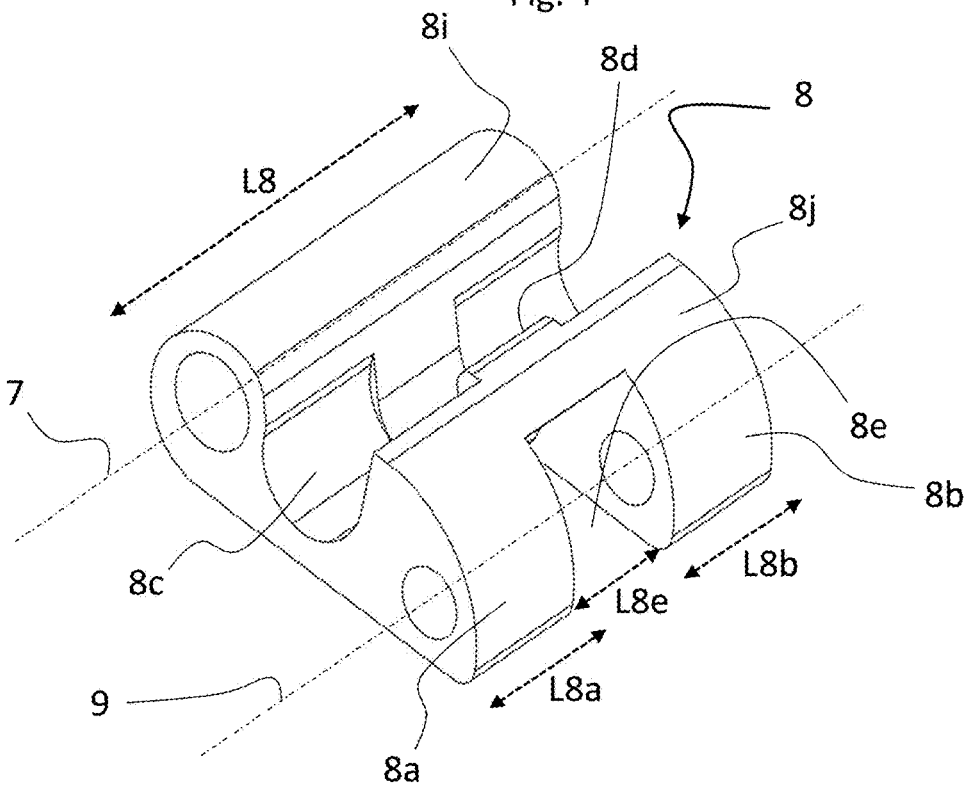
FIG. 4 depicts a perspective view of an end link of the device for adjusting the length of a bracelet according to the embodiment of the present invention.

As more particularly depicted in FIG. 4, the end link 6 has a first bore, at the first end 8*i*, designed to accept the pin 7 of the adjusting link. It has a width L8 less than the width L of the bracelet and of the clasp, so that its first end 8*i* bearing the first bore can be housed between the two outer link elements 6*b*, 6*c* of the adjusting link 6 when it is mounted about the pin 7. This width L8 is equal to the sum of the widths of the three center link elements 11*a*, 10*a*, 11*b* of the bracelet.

Figure 7:
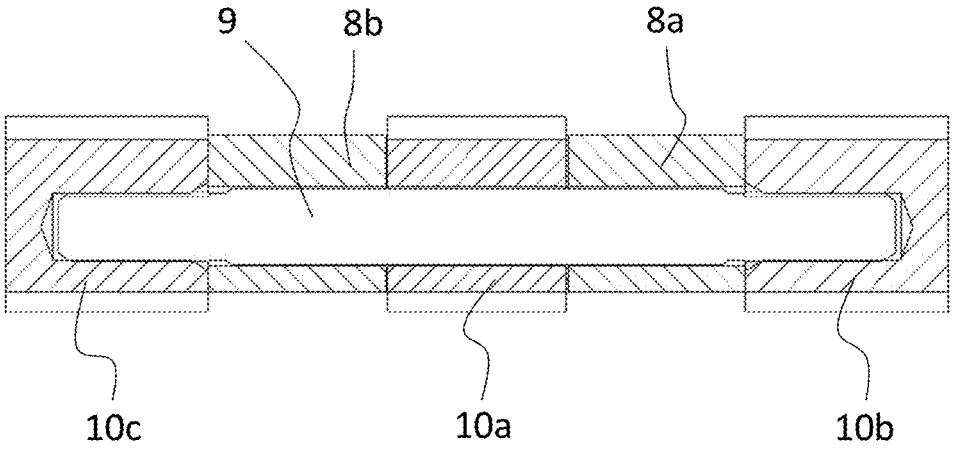
FIG. 7 depicts a view in cross section of the device for adjusting the length of a bracelet according to the embodiment of the present invention.

The end link 8 has a second bore, at a second end 8*j*, designed to accept the second pin 9, particularly visible in FIG. 7, so as to make the connection with the link made up of the three link elements 10*a*, 10*b*, 10*c* forming the end of the strand of the bracelet which is connected to it. At this second end 8*j*, the end link 8 has at least one cutout 8*e* extending longitudinally, which is designed to accept a center link element 10*a* of a link 10 of the strand of the bracelet, as will be detailed hereinafter. This cutout 8*e*, positioned in a central part of the end link 8, delimits two parts 8*a*, 8*b* which notably repeat the curvature of the surface of the center link elements of the bracelet, notably the two link elements 11*a*, 11*b* of a second link 11. This cutout 8*e* may be formed by machining into the second end 8*j* of the end link 8, so that it ultimately has a shape delimited by two planar parallel lateral flanks oriented in the longitudinal vertical direction, which corresponds substantially to the geometry of at least part of a center link element of the bracelet, so that this link element is housed with minimal clearance within the cutout, in a manner that is articulated about the second pin 9. Advantageously this cutout 8*e* goes all the way through the second end 8*j* of the end link 8 in the longitudinal direction.

Finally, the two ends 8*i*, 8*j* of the end link 8, which respectively bear the two bores to accept the two pins 7, 9, are connected by a transverse cutout 8*c* of substantially semi-cylindrical shape. It additionally comprises a wall 8*d* in the shape of an S substantially in a central position of this cutout 8*c*, and the size of which is designed to be slightly smaller than the bar that forms the first pin 5, so as to be able to clip elastically onto this pin 5, when the adjusting device is in a short configuration. This wall 8*d* thus forms a narrowing at the entry to the housing formed by the transverse cutout 8*c*, the dimension of which is calculated to be slightly smaller than the corresponding dimension of the part of the pin 5 that is to engage in the housing. This wall 8*d* therefore acts as a means of attachment for the pin 5 when engaged elastically in this housing when the adjusting device is in the short configuration. This transverse cutout 8*c* additionally truncates the second end 8*j* of the end link, of which the two lateral parts 8*a*, 8*b* around the cutout 8*e* repeat the shape of half link elements 11*a*, 11*b* intersected at their center by a transverse midplane.

Observe that the end link 8 comes in a single piece. Its two ends 8*i*, 8*j* are joined together securely, without respective motion. The end link 8 therefore forms a monolithic component. It takes the form of a one-piece component.

Figure 1:
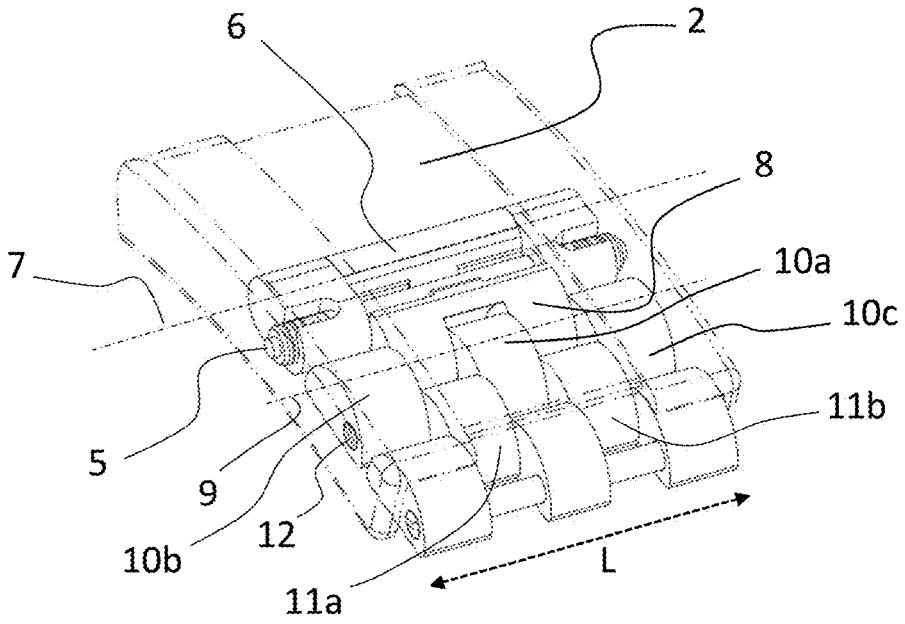
FIG. 1 depicts a perspective view of a device for adjusting the length of a bracelet in the short configuration, according to one embodiment of the present invention.

FIG. 1 depicts the adjusting device in the short configuration. The adjusting link 6 is arranged in such a way that its pin 7 is positioned toward the inside of the clasp, on the opposite side of its pin 5 to the end of the bracelet. In this configuration, the transverse cutout 8*c* of the end link 8 accepts the central part of the first pin 5 of the adjusting link 6 and the wall 8*d* is fixed on this pin and allows said end link 8 to be fixed in this position, ensuring the stability of the short configuration of the adjusting device.

Figure 2:
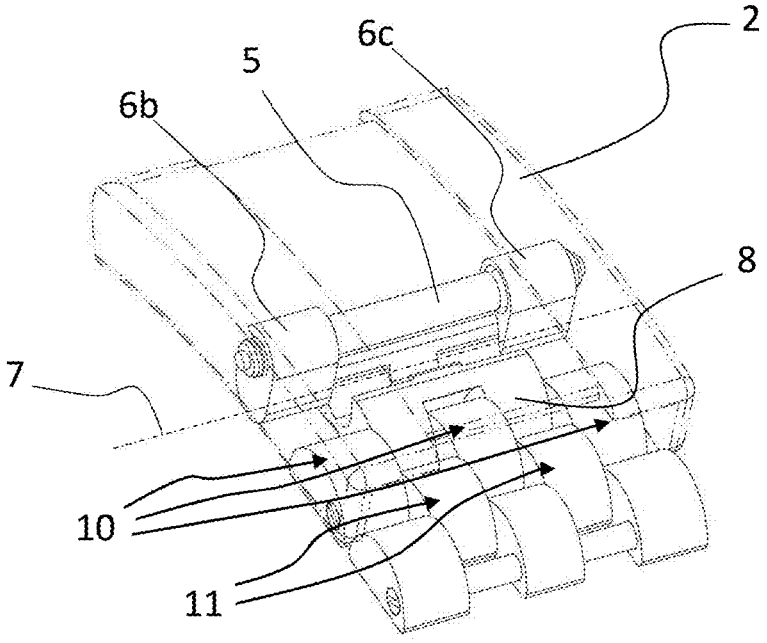
FIG. 2 depicts a perspective view of the device for adjusting the length of a bracelet in an intermediate configuration, according to the embodiment of the present invention.

FIG. 2 depicts an intermediate configuration in which the adjusting link 6 has begun to rotate about its first pin 5, which represents an axis about which the adjusting link pivots relative to the cover of the clasp. In this illustration, it has performed approximately a quarter turn, thus positioning its second pin 7 at the same longitudinal level as the pin 5, superposed underneath this pin 5 in relation to the cover 2.

Figure 3:
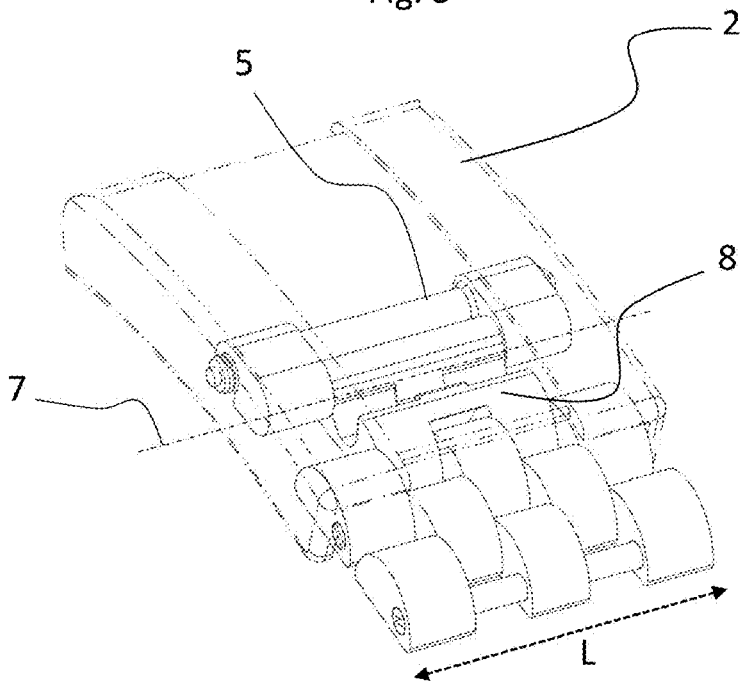
FIG. 3 depicts a perspective view of a device for adjusting the length of a bracelet in the long configuration, according to the embodiment of the present invention.

FIG. 3 finally illustrates the long configuration of the bracelet which is obtained when the adjusting link 6 has completed its rotation about the pin 5, the second pin 7 returning to the same height as the pin 5, in abutment under the cover 2. The adjusting link 6 has therefore performed a rotation of substantially 180 degrees with respect to its first pin 5, and the second pin 7 is thus positioned on the same side of this first pin 5 as the strand of bracelet.

The adjusting device according to the invention makes it possible to effect an adjustment in length between two determined bracelet lengths. The transition from one position to the other can be obtained only deliberately, through a simple manipulation that does not require any particular skill on the part of the user. Specifically, the change in configuration of the adjusting device is obtained by simple force deliberately applied by the user to the end of his or her bracelet in the desired direction of actuation. Once placed in a chosen configuration, there is no risk of the length changing unintentionally. This adjusted length is maintained for as long as the user has not decided otherwise. The clasp can be opened and closed without the adjustment being changed. It may also be pointed out that in each of the length configurations, the height of the clasp remains unchanged which means that this device does not detract from the esthetic appearance of the bracelet.

FIGS. 5 and 6 illustrate the adjusting device in its short configuration. They allow sight of the pin 9 mounted at the second end 8*j* of the end link 8, on which is mounted a first bracelet link 10 having three link elements 10*a*, 10*b*, 10*c* as described earlier. In particular, these figures provide an illustration of how the center link element 10*a* is integrated into the central cutout 8*e*. Its lateral flanks come almost into contact with the lateral flanks of the cutout, allowing it to pivot with minimal clearance relative to the end link 8. The two parts 8*a*, 8*b* around the cutout 8*e* are thus respectively positioned between the link elements 10*a*, 10*b* and 10*a*, 10*c*, in the manner of a second bracelet link 11. The three link elements 10*a*, 10*b*, 10*c* of the link 10 have passing through them a second pin 12 intended to receive the articulated connection of a second link 11, the two link elements 11*a*, 11*b* of which would be in continuity with the two parts 8*a*, 8*b* of the end link 8, as visible in FIGS. 1 to 3 and 8. By means of this architecture, it emerges that the end link 8 may make the connection between the link for adjusting the length of the bracelet and the end of the bracelet while at the same time ensuring the esthetic integrity of the bracelet, in the two, short and long, configurations of the adjusting device, even in the depicted example of an architecture which is complex on account of its numerous small-sized link elements. In addition, this end link 8 ensures that the bracelet is comfortable all the way to its end.

FIG. 7 depicts a view in cross section at the central part of a pin 9. It shows the connection between the three link elements 10*a*, 10*b*, 10*c* of the bracelet and the end link 8. The pin 9 is driven into the bores of the outer link elements 10*b*, 10*c* and fitted with minimal clearance within the bore of the center link element 10*a*.

The solution according to the embodiment is particularly well suited to a bracelet comprising articulated links and, more particularly, links comprising several link elements, these being center link elements and outer link elements as explained hereinabove. In such a structure, the width of all or some of the center link elements 10*a*, 11*a*, 11*b* is less than or equal to that of an outer link element 10*b*, 10*c*. More preferably still, the center link element 10*a* of one link has a width L10*a* less than or equal to the width L10*b* of the first outer link element 10*b* and/or less than or equal to the width L10*c* of the second outer link element 10*c* (FIG. 6). Advantageously too, the widths of the link elements satisfy the following conditions: $1 \leq L10b/L10a < 1.5$, or even $<1.3$, or even $<1.2$ and/or $1 \leq L10c/L10a < 1.5$, or even $<1.3$, or even $<1.2$.

The width L8*e* of the cutout 8*e* corresponds substantially to the width L10*a* of a center link element 10*a* of a link of the bracelet, as explained hereinabove, and may therefore likewise be less than or equal to the width of at least one outer link element L10*b*, L10*c* and possibly satisfy the following condition or conditions: $1 \leq L10b/L8e < 1.5$, or even $<1.3$, or even $<1.2$ and/or $1 \leq L10c/L10a < 1.5$, or even $<1.3$, or even $<1.2$.

Furthermore, since the width L8*a*, L8*b* of the two lateral parts 8*a*, 8*b* of the end link 8 corresponds to that of the center link elements 11*a*, 11*b*, this width is advantageously substantially equal to the width of the center link element L10*a* (namely also L8*e*). Finally, the width L10*b*, L10*c* of the outer link elements 10*b*, 10*c* which are arranged against the outer flanks of the end link 8 in the continuation of the two outer link elements 6*b*, 6*c* of the adjusting link 6 corresponds more or less to the width of these two outer link elements 6*b*, 6*c* of the adjusting link 6.

However, there is nothing to stop the adjusting device described hereinabove being used with other types of bracelets comprising a different number of link elements, or even a leather or plastic bracelet for example. Likewise, it may just as well be a watch bracelet as any other type of bracelet for any object to be secured to a wrist or any other part of the body. This object may be a deep sea diving accessory such as a depth meter or a dive computer for example, or even an item of jewelry.

Furthermore, the adjusting device is particularly well suited to a clasp of the multi-fold type or of a comparable type, and generally to any bracelet which together with its clasp forms an endless connection. It can for example be adapted to a three-fold clasp comprising a central leaf to the ends of which there are respectively mounted, with the ability to pivot, a foldable first mobile leaf and a foldable second mobile leaf.

More generally, the device for adjusting the length of the bracelet as described hereinabove is advantageously associated with any folding leaf of a clasp.

Advantageously, the adjusting link and possibly at least part of the end link lies under a cover formed by the clasp, this mechanism thus remaining hidden. The visible part guarantees the esthetic integrity of the bracelet, in both configurations of the adjusting device, as explained hereinabove.

The invention also relates to a bracelet and/or a clasp that incorporates/incorporate at least one device for adjusting the length of the bracelet. A device for adjusting the length of the bracelet may be arranged at each end of the strands of the bracelet, or at just one end.

The adjusting device according to the invention may be modified without departing from the scope of the present invention. In particular, the adjusting link may take other forms. It comprises an element which cooperates with the end link in the short configuration so as to allow the two links to catch together. In addition, the end link 8 may even take other forms. In particular, its second end 8*j* conforms to the design of the bracelet and may comprise several parallel cutouts 8*e* and any other number of parts imitating a bracelet link element.

The invention claimed is:

1. A bracelet comprising:

a strand of a succession of first and second links, each of the first links comprising one center link element and two outer link elements, and each of the second links comprising two center link elements, wherein the first and second links are joined together in an articulated manner by at least one transverse pin, so that each of the link elements of the first and second links are juxtaposed in parallel across a width of the bracelet, each of the two center link elements of the second link being interposed between the center link element and a respective one of the two outer link elements of the first link and the two center link elements of the second link being offset longitudinally with respect to the one center link element and the two outer link elements of the first link, and at least one device for adjusting a length of the bracelet, wherein the adjusting device comprises:

an adjusting link equipped with first and second parallel transverse articulation pins, the first pin being fixed and the second pin being able to pivot with respect to the first pin so as to reverse the respective longitudinal positions of these two articulation pins relative to one another and respectively create a short configuration and a long configuration of the adjusting device, and an end link comprising:

a first end pivoted on the second pin of the adjusting link, and a second end configured to accept fixing of an end of a strand of the bracelet, the second end comprising:

(i) at least one first cutout designed to house a center link element of a link at the end of the strand of the bracelet, and (ii) a transverse second cutout arranged between the first and second ends of the end link to house the first pin of the adjusting link when the adjusting device is in the short configuration, and a wall arranged at a level of the transverse second cutout of the end link to collaborate with the first pin of the adjusting link when the adjusting device is in the short configuration so as to catch on the first pin of the adjusting link and maintain the short configuration of the adjusting device in a stable manner, and wherein the wall forms a protrusion only in a central portion of the second cutout along a length of the transverse second cutout, so as to catch the first pin only in the central portion of the second cutout in the short configuration, wherein the end of a strand of the bracelet comprises one of the first links being articulated on a pin connected to the second end of the end link, the center link element of the first link being partially housed inside the first cutout of the end link and the two outer link elements of the first link covering part of exterior flanks of two lateral parts of the second end of the end link surrounding the first cutout.

2. The bracelet as claimed in claim 1, wherein the second end of the end link of the adjusting device has two planar flanks delimiting two lateral parts through which passes a through-bore to accept the pin connecting to the end of the strand of the bracelet.

3. The bracelet as claimed in claim 2, wherein the first cutout of the adjusting device has two flanks arranged in parallel planes oriented longitudinally and vertically.

4. The bracelet as claimed in claim 1, wherein the two lateral parts of the second end of the end link surrounding the first cutout of the device for adjusting the length of the bracelet have a visible surface that is curved, imitating the shape of a link element of a bracelet.

5. The bracelet as claimed in claim 1, wherein the adjusting link of the device for adjusting the length of the bracelet has the two outer link elements connected by the two pins of the adjusting link, and has an overall width substantially equal to the width of the bracelet, and wherein the end link has a width less than a difference between a width of the adjusting link and a sum of widths of the two outer link elements, so that the end link can be interposed between the two outer link elements when the adjusting device is in the short configuration.

6. The bracelet as claimed in claim 1, wherein the wall of the device for adjusting the length of the bracelet is shaped as an S, and is slightly smaller than a dimension of a bar forming the first pin of the adjusting link, so as to be able to be clipped elastically onto this pin.

7. The bracelet as claimed in claim 1, wherein the end link of the device for adjusting the length of the bracelet is in the form of a one-piece component.

8. The bracelet as claimed in claim 1, comprising a multi-fold bracelet clasp, wherein the first pin of the adjusting link is fixed to lateral walls extending a cover of the clasp.

9. The bracelet as claimed in claim 1, wherein the center link elements are arranged between the outer link elements, wherein at least one of the center link elements has a width less than or equal to a width of at least one of the outer link elements.

10. The bracelet as claimed in claim 9, wherein the widths of the link elements satisfy at least one of the following conditions, wherein L10*a* is the width of the center link element and L10*b* and L10*c* are the respective widths of the outer link elements:

$$1 \leq L10b/L10a < 1.5,$$

$$1 \leq L10c/L10a < 1.5.$$

11. The bracelet as claimed in claim 9, wherein the widths of the link elements satisfy at least one of the following conditions, wherein L10*a* is the width of the center link element and L10*b* and L10*c* are the respective widths of the outer link elements:

$$1 \leq L10b/L10a < 1.3,$$

$$1 \leq L10c/L10a < 1.3.$$

12. The bracelet as claimed in claim 9, wherein the widths of the link elements satisfy at least one of the following conditions, wherein L10*a* is the width of the center link element and L10*b* and L10*c* are the respective widths of the outer link elements:

$$1 \leq L10b/L10a < 1.2,$$

$$1 \leq L10c/L10a < 1.2.$$

13. The bracelet as claimed in claim 1, wherein a width of the first cutout of the end link is substantially equal to a width of the center link element of a link of the bracelet so as to allow the center link element of the first link to be housed with minimal clearance.

14. The bracelet as claimed in claim 1, wherein at least one selected from the group consisting of (i) a width of the first cutout of the end link is less than or equal to a width of at least one of the outer link elements, and (ii) the widths satisfy at least one of the following conditions, wherein L8*e* is the width of the first cutout of the end link and L10*b* and L10*c* are the respective widths of the outer link elements:

$$1 \leq L10b/L8e < 1.5,$$

$$1 \leq L10c/L8e < 1.5.$$

15. The bracelet as claimed in claim 14, wherein the width of the first cutout of the end link is less than or equal to a width of at least one outer link element.

16. The bracelet as claimed in claim 14, wherein the widths satisfy at least one of the following conditions:

$$1 \leq L10b/L8e < 1.3,$$

$$1 \leq L10c/L8e < 1.3.$$

17. The bracelet as claimed in claim 14, wherein the widths satisfy at least one of the following conditions:

$$1 \leq L10b/L8e < 1.2,$$

$$1 \leq L10c/L8e < 1.2.$$

18. The bracelet as claimed in claim 1, wherein a width of the two lateral parts of the second end of the end link surrounding the first cutout is substantially equal to a width of the link elements of the second link of the bracelet, and wherein an upper surface of the two lateral parts imitates a shape of a visible surface of the link elements of the second link.

19. A wrist watch which comprises at least one bracelet as claimed in claim 1.

* * * * *